US005792014A

United States Patent [19]

Brown

[11] Patent Number: 5,792,014

[45] Date of Patent: Aug. 11, 1998

[54] VOLLEYBALL TRAINING APPARATUS AND METHOD

[76] Inventor: Stephen Brown, 315 Baker Rd., Ambler, Pa. 19002-2214

[21] Appl. No.: 844,130

[22] Filed: Apr. 18, 1997

[51] Int. Cl.[6] ..... A63B 69/00

[52] U.S. Cl. ..... 473/430; 473/459

[58] Field of Search ..... 473/423, 427, 473/429, 430, 431, 459, 473

[56] References Cited

U.S. PATENT DOCUMENTS

| | | | |
|---|---|---|---|
| 3,301,556 | 1/1967 | Hamilton, Jr. et al. | 473/430 |
| 4,296,925 | 10/1981 | Alston . | |
| 4,798,390 | 1/1989 | Dooley . | |
| 4,881,742 | 11/1989 | Hargreave . | |
| 4,948,150 | 8/1990 | Daly . | |
| 5,060,946 | 10/1991 | Taylor . | |
| 5,280,843 | 1/1994 | Vartija . | |
| 5,398,940 | 3/1995 | Derst . | |
| 5,520,397 | 5/1996 | Thompson . | |
| 5,575,481 | 11/1996 | Lovetere . | |

*Primary Examiner*—William H. Grieb
*Attorney, Agent, or Firm*—LaMorte & Associates

[57] ABSTRACT

A volleyball practice device and method that enables a player to practice spiking a volleyball. The device includes a tether with an attachment device at one end that enables the tether be attached to a regulation play volleyball. The tether is suspended from a support bracket that can be attached to a basketball hoop. The tether is used to hoist the volleyball to a height that is appropriate to practice spiking. The tether is then placed in a quick release mechanism, wherein the weight of the suspended volleyball keeps the tether taut in between the volleyball and the quick release mechanism. As the volleyball is spiked, the tether detaches from the quick release mechanism. The volleyball therefore travels in the direction that it was spiked without being significantly hampered by the attached tether. The tail end of the tether is anchored. After the volleyball travels a predetermined distance, the tether pulls taut and the volleyball is stopped. The volleyball can then be returned to its hoisted position by the tether and readied for another practice spike.

12 Claims, 5 Drawing Sheets

VOLLEYBALL TRAINING APPARATUS AND METHOD

BACKGROUND OF THE INVENTION

1. Field of the Invention

In general, the present invention relates to field of practice devices for the game of volleyball. More particularly, the present invention relates to devices that suspend a volleyball over a player's head and enable the player to practice spiking the volleyball.

2. Description of the Prior Art

In the game of volleyball, spiking is a fundamental maneuver whereby a player spikes a volleyball and drives the volleyball over the net at a descending angle. In order for a player to spike a volleyball, the volleyball must be located at a point above the net when the volleyball is struck. During a game of volleyball, a player can spike the volleyball only after another player has lofted the volleyball to a point above the net. Consequently, in the game of volleyball, a spike requires two players, one to loft the volleyball in place and the other to spike the volleyball over the net.

Since spiking a volleyball is generally a two person activity, it is difficult for a volleyball player to practice spiking by himself or herself. In the prior art, devices have been developed to assist a lone person practice spiking a volleyball. Most of these devices suspend a volleyball at a height above that of the volleyball net. As such, the need for a person to loft the volleyball is eliminated and a single person can practice spiking. In the prior art, volleyball spiking aids generally fall into two separate classes. The first class includes gravity feed tees, wherein multiple volleyballs are held in a suspended tee mechanism. The tee mechanism places one volleyball in a position where it can be spiked. After the volleyball is spiked, another volleyball automatically fills the void, thereby readying the device for another spike. Such prior art gravity feed tees are exemplified by U.S. Pat. No. 4,798,390 to Dooley, entitled VOLLEYBALL SPIKING TEE; and U.S. Pat. No. 5,520,397 to Thompson, entitled VOLLEYBALL GRAVITY FEED PRACTICE APPARATUS. The problem with gravity feed spiking tees is that a person must own multiple volleyballs in order to properly use the device. Furthermore, a player practicing spikes must chase after the various volleyballs after they are spiked. This makes such a prior art device impractical to many volleyball players who choose to practice in an unconfined space.

The second class of volleyball spiking devices includes tethered ball devices. Tethered ball devices suspend a single volleyball from a tether. As the volleyball is spiked, the volleyball swings about its tether. Such prior art devices are exemplified by U.S. Pat. No. 4,948,150 to Daly, entitled VOLLEYBALL PRACTICE SYSTEM; U.S. Pat. No. 5,575,481 to Lovetere, entitled VOLLEYBALL TRAINING AID; and U.S. Pat. No. 5,398,940 to Derst, entitled SOCCER HEADER PRACTICE APPARATUS. The problem associated with such prior art tethered volleyball devices is that the tether prevents the volleyball from traveling in the direction in which the volleyball was spiked. As a result, the player practicing spiking does not know where he/she has directed the ball. Rather, the player can only tell that they struck the ball. Often a player wants to practice spiking the volleyball to a specific point on the opponent's side of the court. Using prior art devices with tethered balls prevents a player from engaging in such practice.

U.S. Pat. No. 4,296,925 to Alston, entitled JUMP TRAINER shows a tethered volleyball practice device where the volley ball is tethered to a suspended weight. In the Alston device, if the volleyball where spiked, it would initially travel in the direction that is was propelled. However, as the forces of the tethered weight act upon the volleyball, the volleyball's trajectory and acceleration change. The force of the tethered weight then causes the volleyball to stop and return to its initial spiking position. As a result, the Alston device can not be used by a volleyball player that wants to practice spiking a volleyball to a specific location in the opponent side of the court.

A need therefore exists in the art for a volleyball practice apparatus that uses a single tethered ball yet enables a player to practice spiking that ball to a specific location on the opponent's side of the court. This need is provided for by the present invention as set forth in the below description and claims.

SUMMARY OF THE INVENTION

The present invention is a volleyball practice device and method that enables a player to practice spiking a volleyball. The device includes a tether with an attachment device at one end that enables the tether be attached to a regulation play volleyball. The tether is suspended from a support bracket that can be attached to a basketball hoop. The tether is used to hoist the volleyball to a height that is appropriate to practice spiking. The tether is then placed in a quick release mechanism, wherein the weight of the suspended volleyball keeps the tether taut in between the volleyball and the quick release mechanism. As the volleyball is spiked, the tether detaches from the quick release mechanism. The volleyball therefore travels in the direction that it was spiked without being significantly hampered by the attached tether. The tail end of the tether is anchored. After the volleyball travels a predetermined distance, the tether pulls taut and the volleyball is stopped. The volleyball can then be returned to its hoisted position by the tether and readied for another practice spike.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention device can be used to suspend any type of ball at any height above the ground, the present invention is especially well suited for use in supporting a volleyball at a height of between six feet and eleven feet. Accordingly, by way of example, the present invention will be described as supporting a volleyball in order to set forth the best mode contemplated for the invention.

Figure 1:
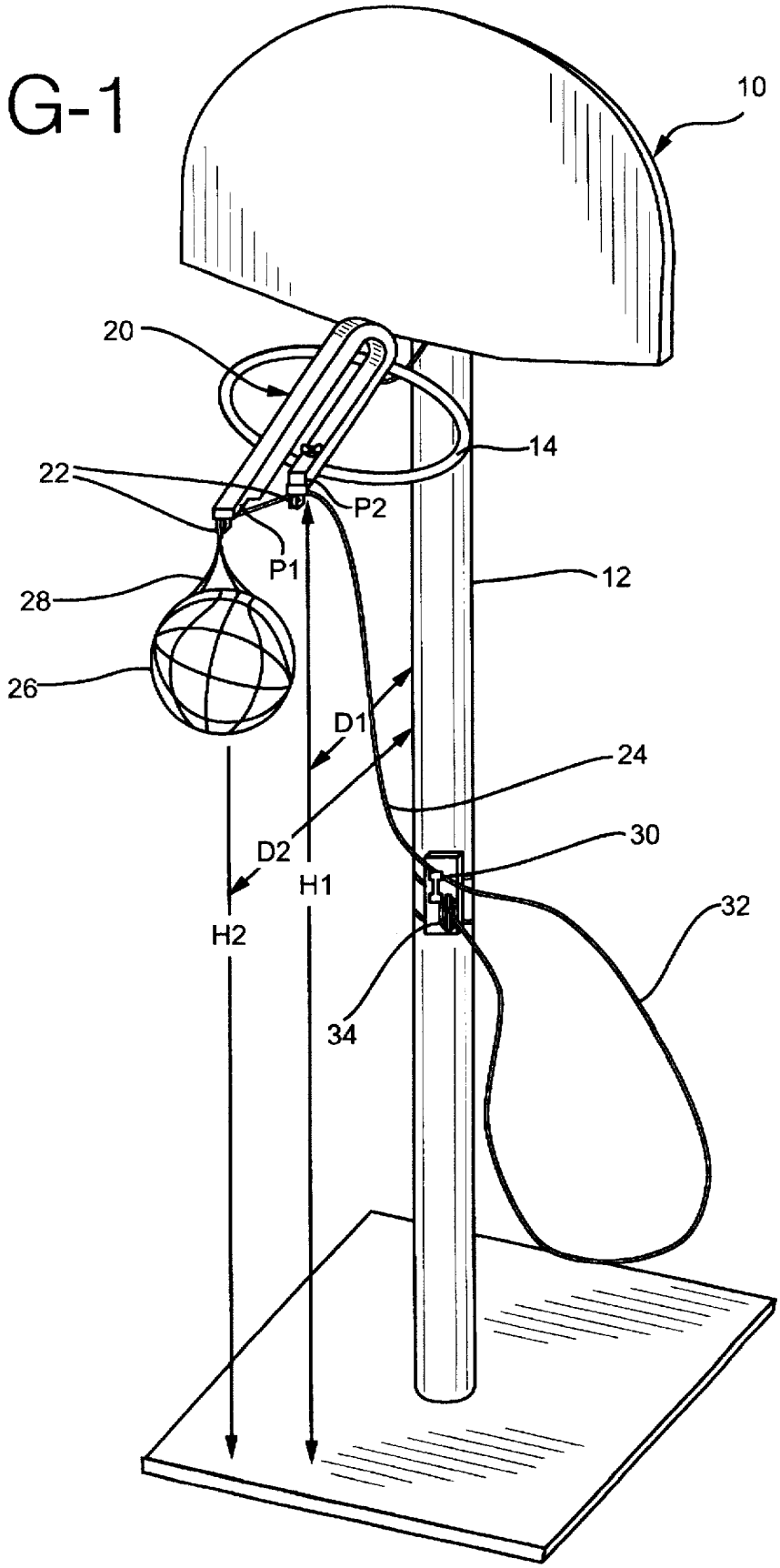
FIG. 1 is a perspective view of an exemplary embodiment of a volleyball practice apparatus in accordance with the present invention. The volleyball practice apparatus is shown in conjunction with a prior art basketball backboard and hoop arrangement.

Referring to FIG. 1, a typical prior art basketball hoop and backboard assembly 10 is shown. The hoop and backboard assembly 10 is supported by a pole 12 that is anchored to the ground. If set for regulation play, the hoop 14 of the hoop and backboard assembly 10 is supported at a height of ten feet.

The present invention includes a ball support device 20 that attaches to the hoop 14 of a hoop and backboard assembly 10. The ball support device 20 has two support points P1, P2 that extend beyond the hoop 14 at two different heights H1, H2 and at two different distances D1, D2 from the backboard. At either of the support points P1, P2, a pulley element 22 can be attached to the ball support device 20. The pulley elements 22 are sized to accept a tether 24 that is used to suspend a volleyball 26 from the ball support device 20. The pulley elements 22 can be pulley wheels or can just be smooth aperture through which the tether 24 passes.

The volleyball 26 can be affixed to the tether 24 in any known manner. However, in the preferred embodiment, the volleyball 26 is a regulation play volleyball that is placed within a suspension net 28. A suitable suspension net is described in U.S. Pat. No. 5,280,843 to Vartija, entitled GAME BALL TRAINING APPARATUS/CARRIER, which is incorporated into this disclosure by reference. The tether 24 can be any flexible element, such as a string, cable or ribbon, that is capable of attaching to the suspension net 28 that supports the volleyball 26.

As will be later explained, the tether 24 extends through one or both of the pulley elements 22 on the ball support device 20. The tether 24 then leads to a quick release mechanism 30 that is affixed to the pole 12 that supports the hoop and backboard assembly 10. To set the volleyball 26 in place, a player pulls on the tether 24 until the volleyball 24 is hoisted to a desired height. The tether 24 is kept taut as the tether 24 is engaged by the quick release mechanism 30. Once engaged by the quick release mechanism 30, the weight of the suspended volleyball 26 keeps the tether 24 taut in between the volleyball 26 and the quick release mechanism 30. A length of slack 32 is then provided in the tether 24 in between the quick release mechanism 30 and a supply spool 34 around which the tether 24 is wound.

Figure 2:
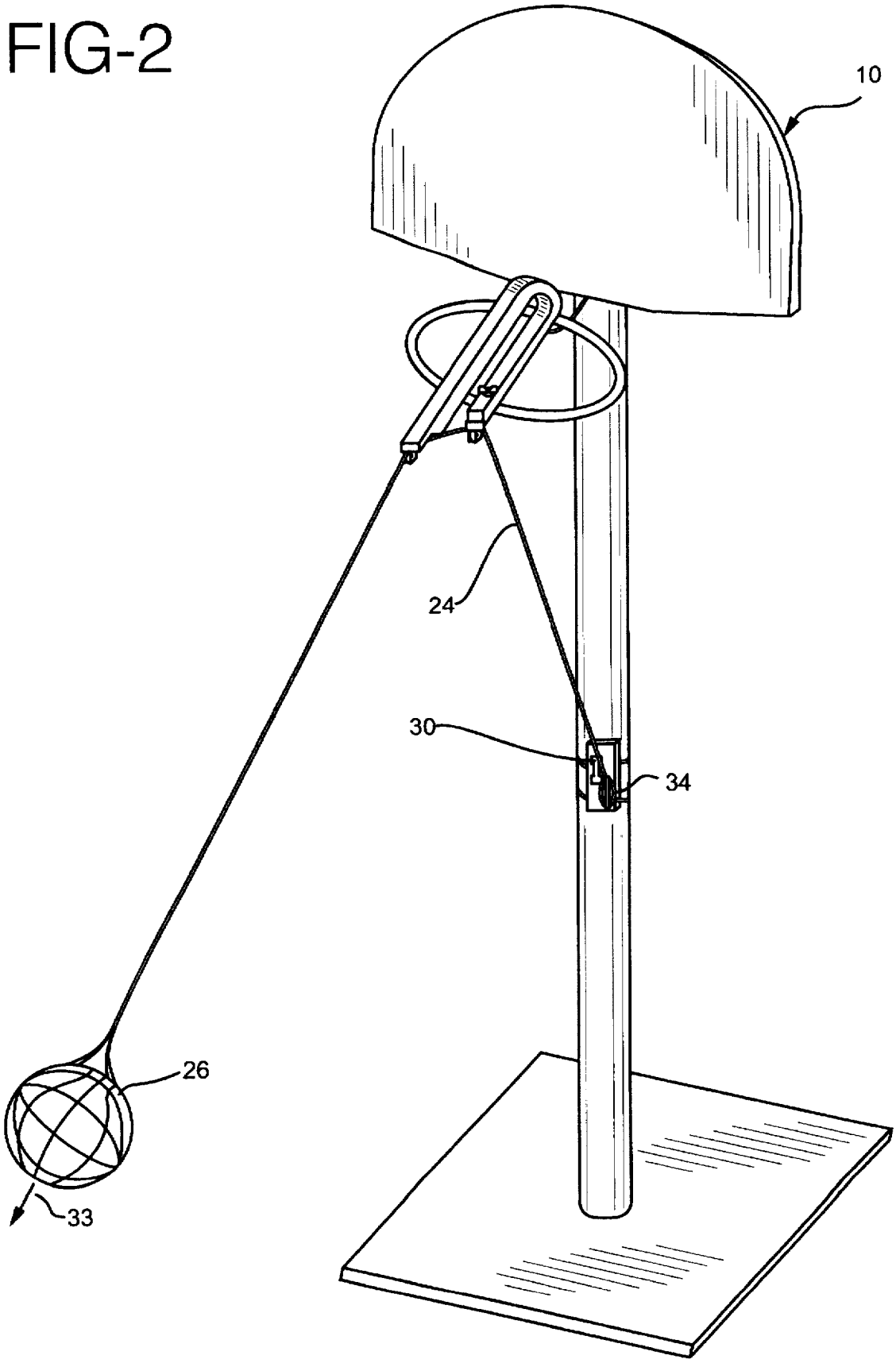
FIG. 2 shows the same embodiment as FIG. 1 at a point in time after a player has spiked a volleyball suspended from the volleyball practice apparatus.

Referring to FIG. 2, it can be seen that as a player spikes the suspended volleyball 26 in the direction of arrow 33, the quick release mechanism 30 disengages the tether 24. As a result, the volleyball 26 is free to travel in the direction it is stuck until all the slack is taken from the tether 24 in between the volleyball 26 and the supply spool 34. Preferably, the amount of slack provided in the tether 24 should be at least several feet long. As a result, when a player strikes the suspended volleyball 26, the player can see in what direction the volleyball 26 travels. The player may even see the volleyball 26 strike the ground on the opponent's side of the court before the tether 24 is pulled taut. As a result, a player can practice spiking the volleyball 26 to a specific location in the opponents side of the court without having the tether 24 interfere with the trajectory of the volleyball 26.

To reset the volleyball 26, after it has been spiked, a player simply pulls on the tether 24 until the volleyball 26 is again hoisted to a desired height. The tether 24 is then placed in the quick release mechanism 30 and the volleyball 26 is held at that height until the volleyball 26 is again struck.

Figure 3:
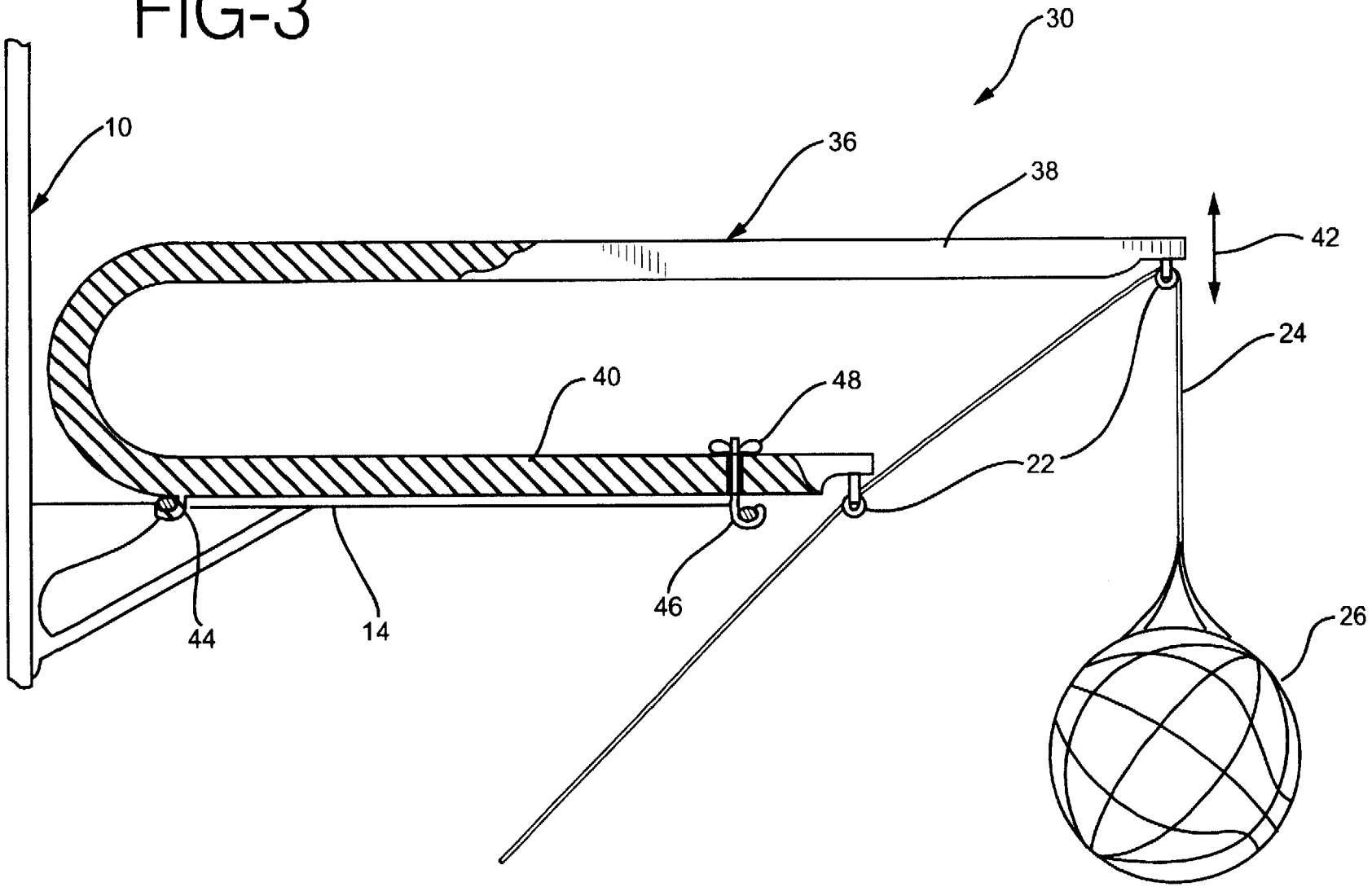
FIG. 3 is a selectively cross-sectioned side view of the volleyball practice apparatus shown in FIG. 1.

Referring to FIG. 3, it can be seen that the shown exemplary embodiment of the ball support device 30 is a generally U-shaped bracket 36 where the upper arm 38 of the U-shaped bracket 36 is longer than the lower arm 40 of the U-shaped bracket 36. Both the upper arm 38 and the lower arm 40 of the U-shaped bracket 38 support the pulley elements 22 at their far ends. The U-shape of the ball support device 30 is merely exemplary and it will be understood that many different bracket configurations can be designed that would support the two pulley elements 22 at the exact same locations. The use of a U-shaped bracket 36 is shown because such a configuration inherently provides the upper arm 38 of the U-shaped bracket 36 with a spring coefficient. As a result, the upper arm 38 of the U-shaped bracket 36 can elastically deform in the directions of arrow 42. This helps the ball support device 30 absorb the forces transferred to the ball support device 30 through the tether 24. As a result, the ball support device 30 is stronger and is less likely to inadvertently move than a similar configuration with no energy absorbing capabilities.

The lower arm 40 of the U-shaped bracket 36 attaches to the hoop 14 of the hoop and backboard assembly 10. A hooked projection 44 extends from the rear of the lower arm 40. The hooked projection 44 is sized to engage the rear rim of the basketball hoop 14. A hook bolt 46 is provided at a point in between the hooked projection 44 and the lower of the two pulley elements 22. The head of the hook bolt 46 is shaped to engage the front rim of the basketball hoop 14. The hook bolt 46 is tightened on the rim of the basketball hoop 14 by a butterfly nut 48 that can be manually tightened and loosened. By engaging the hooked projection 44 with the rear of the basketball hoop 14 and engaging the hook bolt 46 with the front of the basketball hoop 14, the ball support device 30 can be firmly and rapidly affixed to most any existing basketball hoop. It will be understood that the ball support device 30 can be modified to attach to any other support structure, such as a pole or a wall, if a basketball hoop is unavailable. The prior art is replete with devices that attach differently configured brackets to poles and walls. As such, an embodiment showing such an attachment arrangement need not be shown.

The tether 24 can pass through either the lower of the two pulley elements 22 or the upper of the two pulley elements 22, depending upon from where a person would like to have the volleyball 26 suspended. If the volleyball 26 is to be suspended from the upper of the two pulley elements 22, as is shown, then the tether 24 may pass through both the lower pulley element and the upper pulley element. By passing the tether 24 through the lower of the two pulley elements 22, the tether 24 is kept out of the way so that the tether 24 will not interfere with a person striking the volleyball 26.

Figure 4:
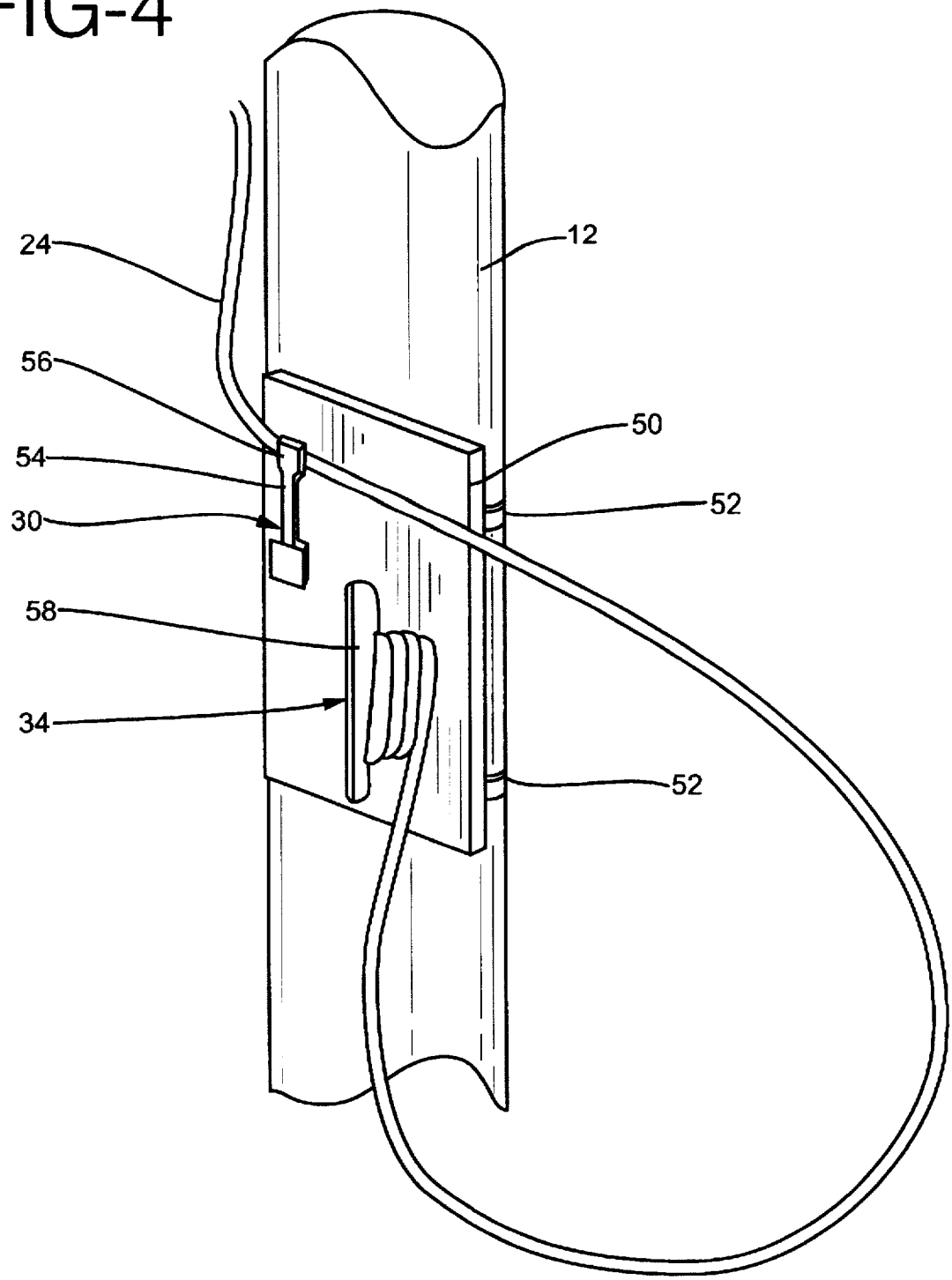
FIG. 4 is a perspective view of the tether quick release mechanism shown in FIG. 1.

Referring to FIG. 4, a first exemplary embodiment of a quick release mechanism 30 and tether supply spool 34 are shown. In this embodiment, the quick release mechanism 30 and supply spool 34, are both affixed to a common base 50. That base 50 is attached to the pole 12 that supports the basketball hoop and backboard assembly 10 (FIG. 1). The base 50 can be attached to the pole 12 with clamping rings 52 (as shown) or any other mechanical fastener such as wire ties, nails, screws and the like. The quick release mechanism 30 can be any mechanism capable of engaging the tether 24 and holding the tether taut 24 until the tether 24 is pulled. The prior art is replete with prior art devices capable of functioning in such a manner. Any such prior art quick release mechanism can be used in conjunction with the present invention. In the embodiment shown, the quick release mechanism 30 is embodied as a flexible pawl 54. The flexible pawl 54 has an enlarged head 56 under which the tether 24 can be placed. The opposite end of the flexible pawl 54 is anchored to the base 50. The head 56 of the pawl 54 is biased against the tether 24 due to the flexible nature of the body of the pawl 54. The friction in between the pawl 54 and the tether 24 is sufficient to support the weight of the volleyball 26 (FIG. 1). However, when the volleyball is spiked, the tether 24 immediately pulls out from under the pawl 54, thereby providing an unrestricted tether 24.

The tether supply spool 34 is embodied as a winged tie down 58. The length of tether 24 that remains slack in between the flexible pawl 54 and the tie down 58 represents how far the volleyball 26 (FIG. 1) can travel before the tether 24 changes the trajectory of the volleyball 26 (FIG. 1). As such, if a player wants the volleyball 26 (FIG. 1) to travel twenty feet before the tether 24 pulls taut, then the player provides for twenty feet of tether slack.

Figure 5:
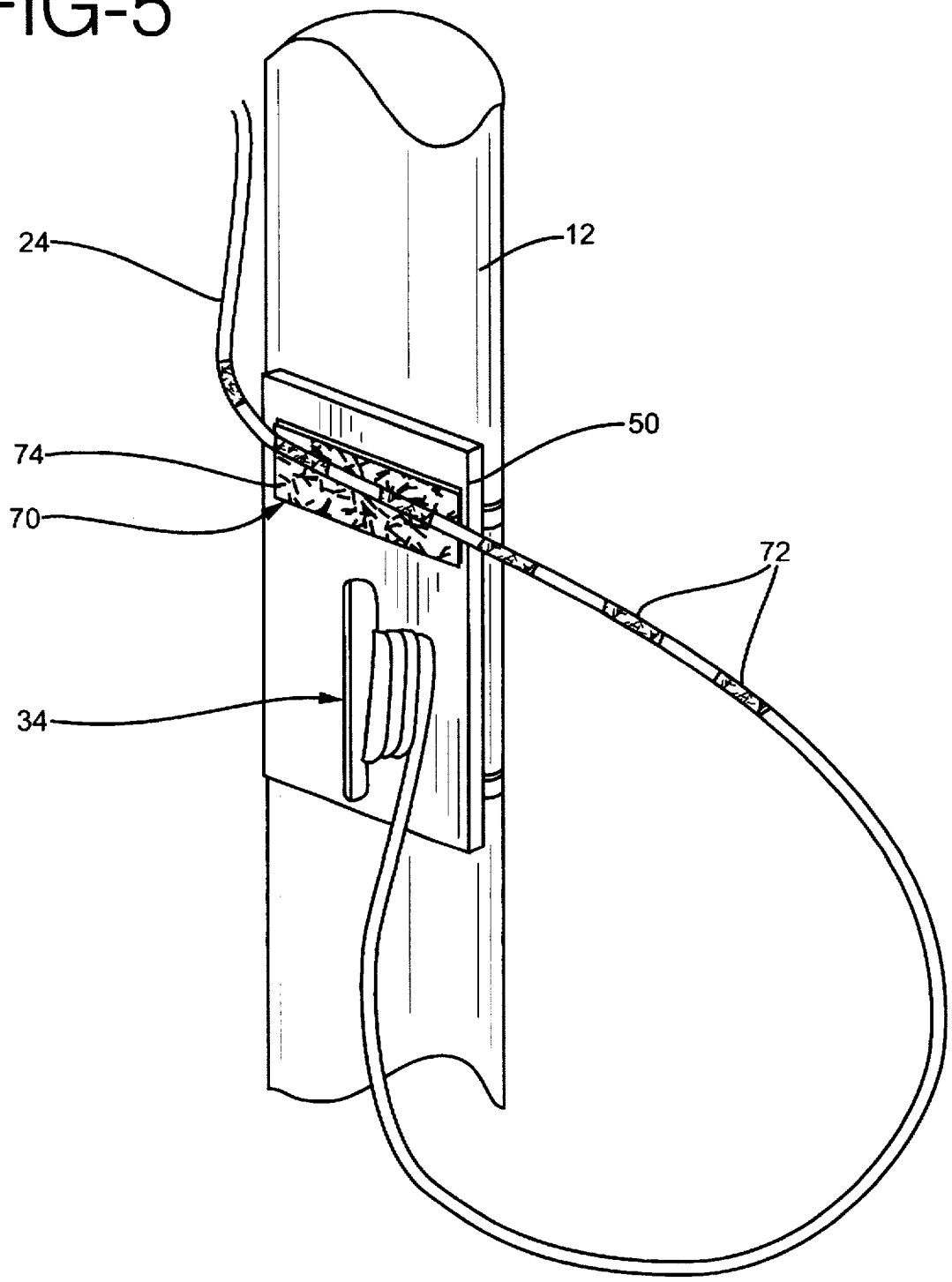
FIG. 5 is a perspective view of an alternate embodiment of a tether quick release mechanism.

Referring to FIG. 5, an alternate quick release mechanism 70 is shown. In this embodiment, small areas of hook and loop fastening material 72 are affixed to the tether 24. An opposite piece of hook and loop fastening material 74 is affixed to the quick release base 50. To attach the tether 24 to the quick release mechanism 70, an area of hook and loop material 72 on the tether 24 is brought into contact with the hook and loop material 74 on the quick release base 50. The mechanical adhesion between the two areas of hook and loop material 72, 74 is sufficient to support the weight of the volleyball 26 (FIG. 1). However, when the volleyball 26 (FIG. 1) is struck, the resultant force is sufficient to separate the two ares of hook and loop material 72, 74, thereby freeing the tether 24 from restrictions.

It will be understood that the embodiments of the present invention described and illustrated herein are merely exemplary and a person skilled in the art can make many variations to the embodiments shown without departing from the scope of the present invention. It should also be understood that various elements from different embodiments can be mixed together to create alternate embodiments that are not specifically described. All such variations, modifications and alternate embodiments are intended to be included within the scope of the present invention as defined by the appended claims.

What is claimed is:

1. A device for suspending a volleyball from a basketball hoop assembly of the type having a vertical backboard and a horizontal hoop, said device comprising:

a first pulley element and a second pulley element;

a bracket selectively attachable to a basketball hoop, wherein said bracket supports said first pulley element a first predetermined distance from the backboard and supports said second pulley element above the first pulley element a second predetermined distance from the backboard, wherein said second predetermined distance is greater than said first predetermined distance;

a tether having a first end and an opposite second end, wherein said tether passes over said first pulley element and said second pulley element, whereby said first end of said tether is suspended from said second pulley element;

a coupling element disposed at said first end of said tether for coupling said tether to a volleyball;

a quick release mechanism for engaging said tether at a point in between said first end and said second end and preventing the movement of said tether along its length until a predetermined force is applied to said first end of said tether, whereby said quick release mechanism releases said tether and enable said tether to move along its length.

2. The device according to claim 1, wherein said coupling element includes a net structure for receiving the volleyball.

3. The device according to claim 1, wherein said first pulley element is supported by said bracket at the same general level as the basketball hoop.

4. The device according to claim 1, wherein said bracket includes an arm that supports said second pulley element, wherein said arm is part of a spring configuration that enables said arm to resiliently deform when stressed.

5. The device according to claim 1, further including at least one hook element that engages both said bracket and the basketball hoop, thereby affixing the bracket to the basketball hoop.

6. The device according to claim 1, wherein said bracket is a generally U-shaped structure having two free ends, wherein said first pulley element and said second pulley element are affixed to said two free ends of said U-shaped structure, respectively.

7. The device according to claim 6, wherein said two free ends of said U-shaped structure are a spaced apart and said U-shaped structure embodies a spring constant that enable the space between the two free ends to elastically vary as said U-shaped structure is stressed.

8. The device according to claim 1, further including at least one hook projection extending from said bracket that engages the hoop when said bracket is placed on said hoop.

9. The device according to claim 8, further including at least one hooked bolt that extends through a portion of said bracket, wherein said hooked bolt is adapted to engage the basketball hoop and affix the bracket to the basketball hoop when tightened.

10. The device according to claim 1, wherein said quick release mechanism is a spring clip that engages said tether.

11. The device according to claim 1, further including segments of hook and loop fastening material on said tether.

12. The device according to claim 11, wherein said quick release mechanism includes a stationary segment of hook and loop fastening material that can be used to selectively engage the hook and loop fastening material on said tether.

* * * * *